US006878681B1

(12) United States Patent
Gohl et al.

(10) Patent No.: US 6,878,681 B1
(45) Date of Patent: Apr. 12, 2005

(54) LAUNDRY RINSE AIDS COMPRISING A PROPOXYLATED QUATERNARY AMMONIUM SALT

(75) Inventors: David Gohl, St. Paul, MN (US); Victor Fuk-Pong Man, St. Paul, MN (US); Robert Hei, Baldwin, WI (US); Brenda Tjelta, St. Paul, MN (US); Paul Mattia, Prior Lake, MN (US)

(73) Assignee: Ecolab, Inc., St. Paul, MN (US)

( * ) Notice: Subject to any disclaimer, the term of this patent is extended or adjusted under 35 U.S.C. 154(b) by 0 days.

(21) Appl. No.: 10/811,276

(22) Filed: Mar. 25, 2004

(51) Int. Cl.[7] ..... C11D 1/62

(52) U.S. Cl. ..... 510/329; 510/276; 510/330; 510/504; 510/515

(58) Field of Search ..... 510/276, 329, 510/504, 515, 330

(56) References Cited

U.S. PATENT DOCUMENTS

| | | | | |
|---|---|---|---|---|
| 4,230,590 | A | * 10/1980 | Wixon | 510/308 |
| 4,799,998 | A | 1/1989 | Dutt | |
| 4,844,822 | A | * 7/1989 | Fox et al. | 510/515 |
| 5,147,715 | A | 9/1992 | Thurman | |
| 5,827,451 | A | 10/1998 | Cummings et al. | |
| 6,159,548 | A | 12/2000 | Moody | |
| 6,277,153 | B1 | 8/2001 | Van Kouwen et al. | |
| 6,350,725 | B1 | 2/2002 | Levitt et al. | |
| 2001/0049247 | A1 | 12/2001 | Mellea et al. | |
| 2002/0029427 | A1 | 3/2002 | Severns et al. | |

* cited by examiner

*Primary Examiner*—Charles Boyer
(74) *Attorney, Agent, or Firm*—Crompton Seager Tufte LLC

(57) ABSTRACT

Compositions and methods of the invention include: providing a wet fabric; contacting the wet fabric with a compound of formula (I):

(I)

where $X^-$ is an anion, R, $R_1$ and $R_2$ are independently selected from $(C_1–C_4)$alkyl, or $(C_1–C_4)$alkoxy, $R_3$ is a polyoxyalkylene chain of formula:

where, n is 35–45; or a compound of formula (II):

(II)

where R is a $(C_1–C_{25})$alkyl, $(C_1–C_{25})$alkoxy, $(C_1–C_{25})$alkenyl, n is 1–50, m is 1–50; and removing water from the wet fabric.

10 Claims, 6 Drawing Sheets

LAUNDRY RINSE AIDS COMPRISING A PROPOXYLATED QUATERNARY AMMONIUM SALT

BACKGROUND OF THE INVENTION

The invention relates to providing rinse aid compounds to wet fabric to aid in dewatering the wet fabric.

For centuries, fabric articles have been washed using water-based processes. In the last century, this chore was greatly simplified by the development of the automatic washing machine. However, while greatly simplifying the laundry process, even the laundry process using the automatic washing machine still requires a significant amount of energy to dry the wet laundry articles that emerge from the washing machine.

There remains a need, therefore, to develop rinse aid compositions that aid in reducing the amount of drying time or energy required to dry laundry.

BRIEF DESCRIPTION OF FIGURES

The invention may be more completely understood in consideration of the following detailed description of various embodiments of the invention in connection with the accompanying drawings, in which.

Figure 1:
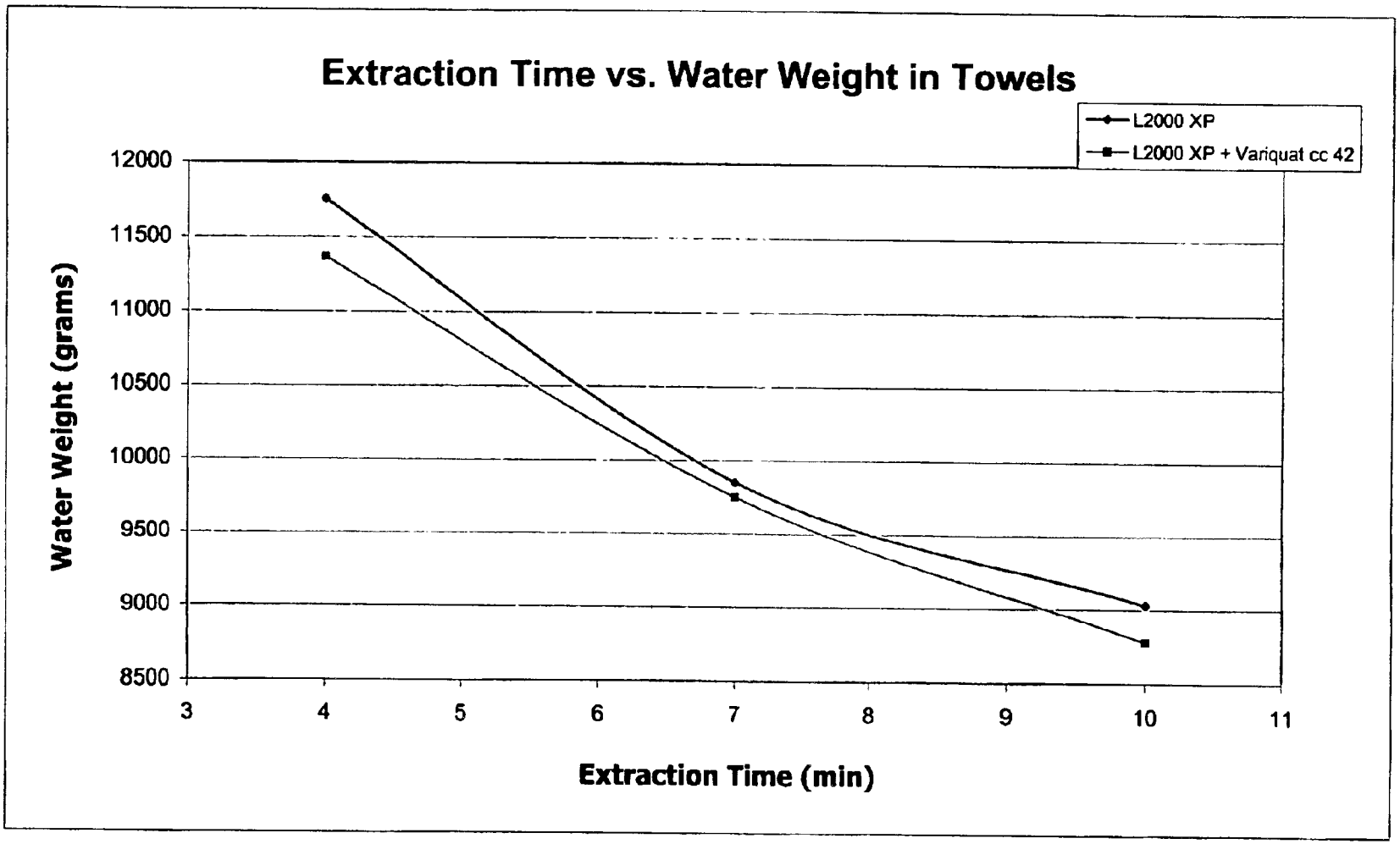
FIG. 1 is a graph of Extraction Time verses Water Weight in Towels using a rinse aid of the invention.
Figure 2:
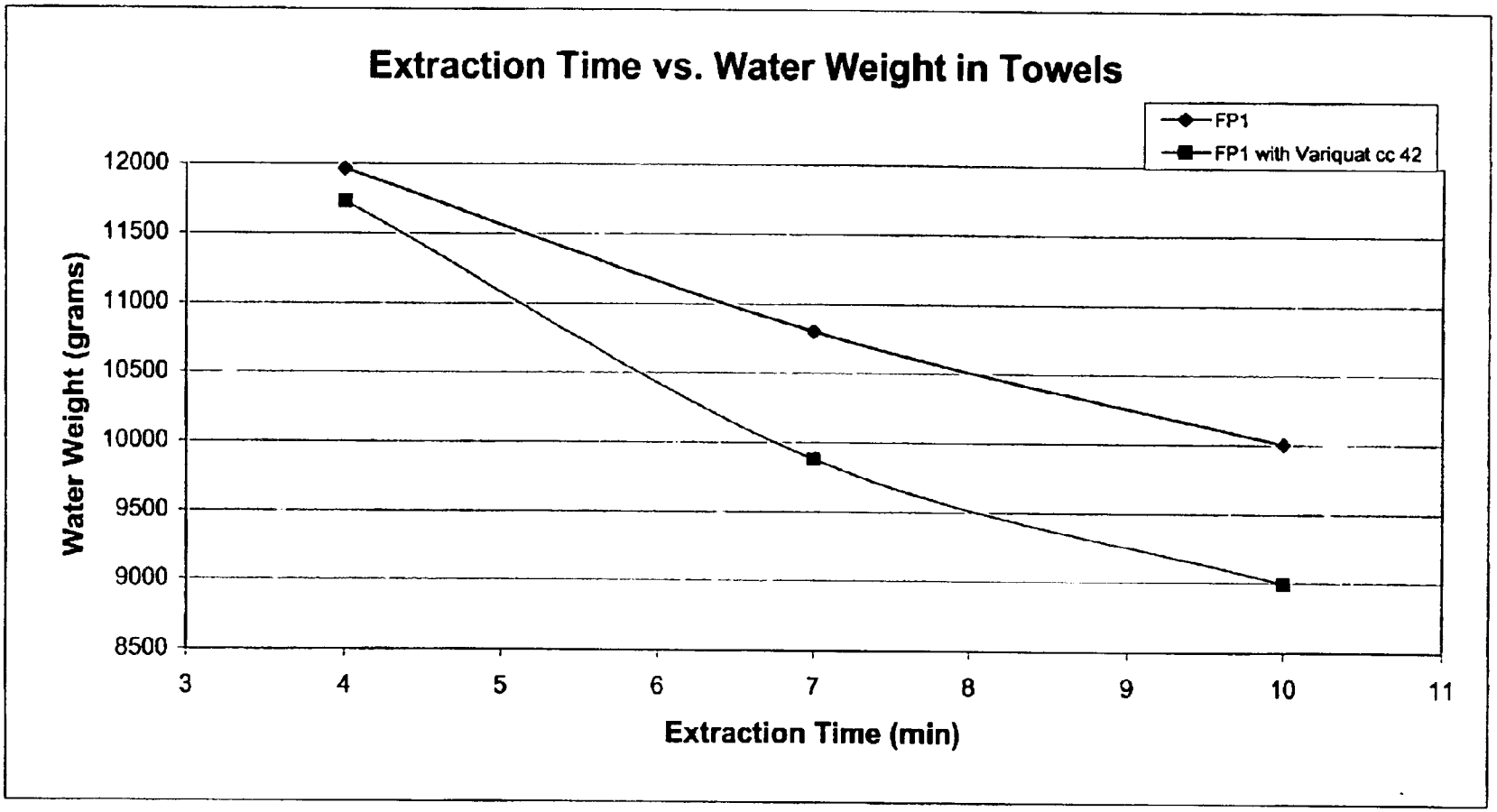
FIG. 2 is a graph of Extraction Time verses Water Weight in Towels using a rinse aid of the invention.
Figure 3:
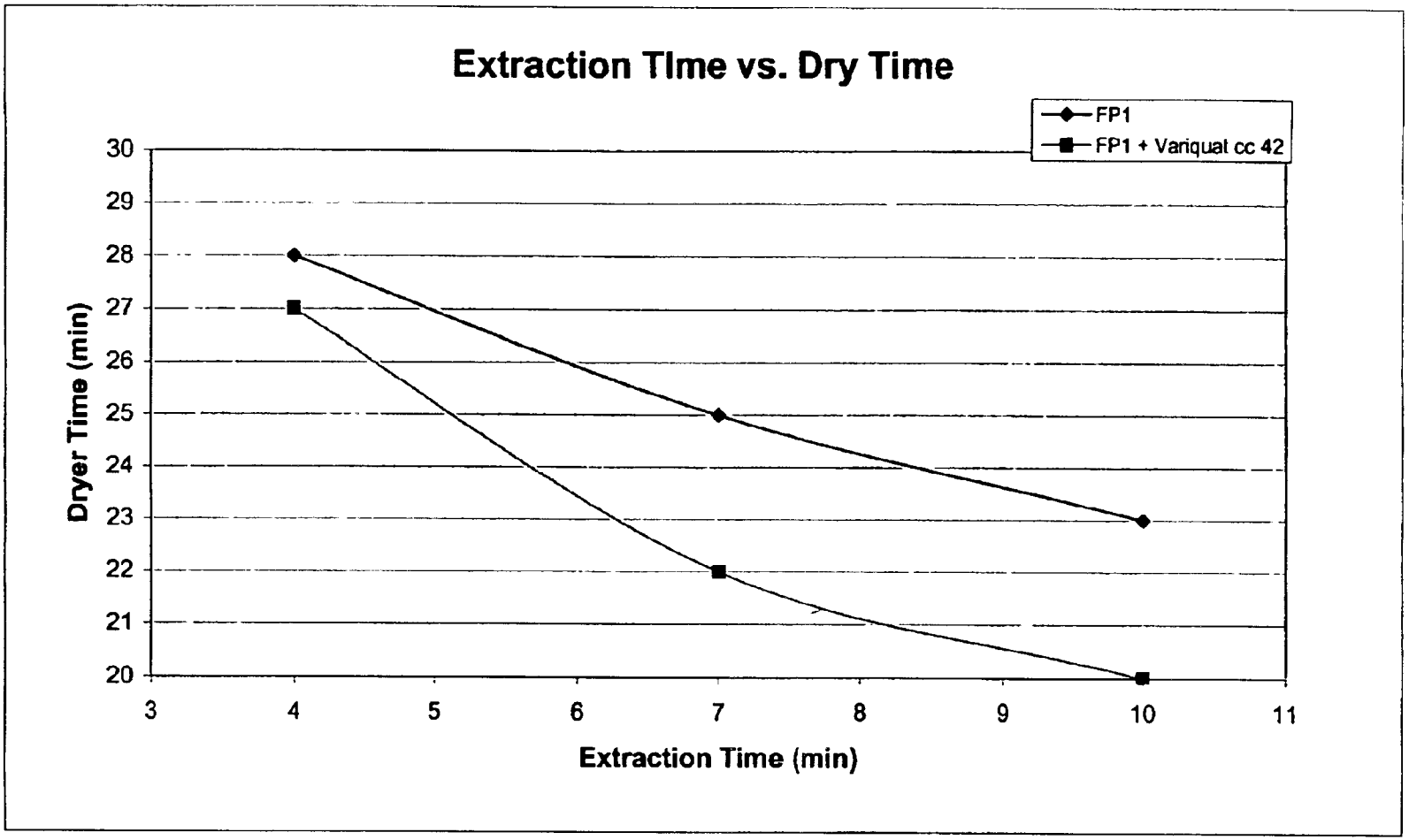
FIG. 3 is a graph of Extraction Time verses Dry Time using a rinse aid of the invention.
Figure 4:
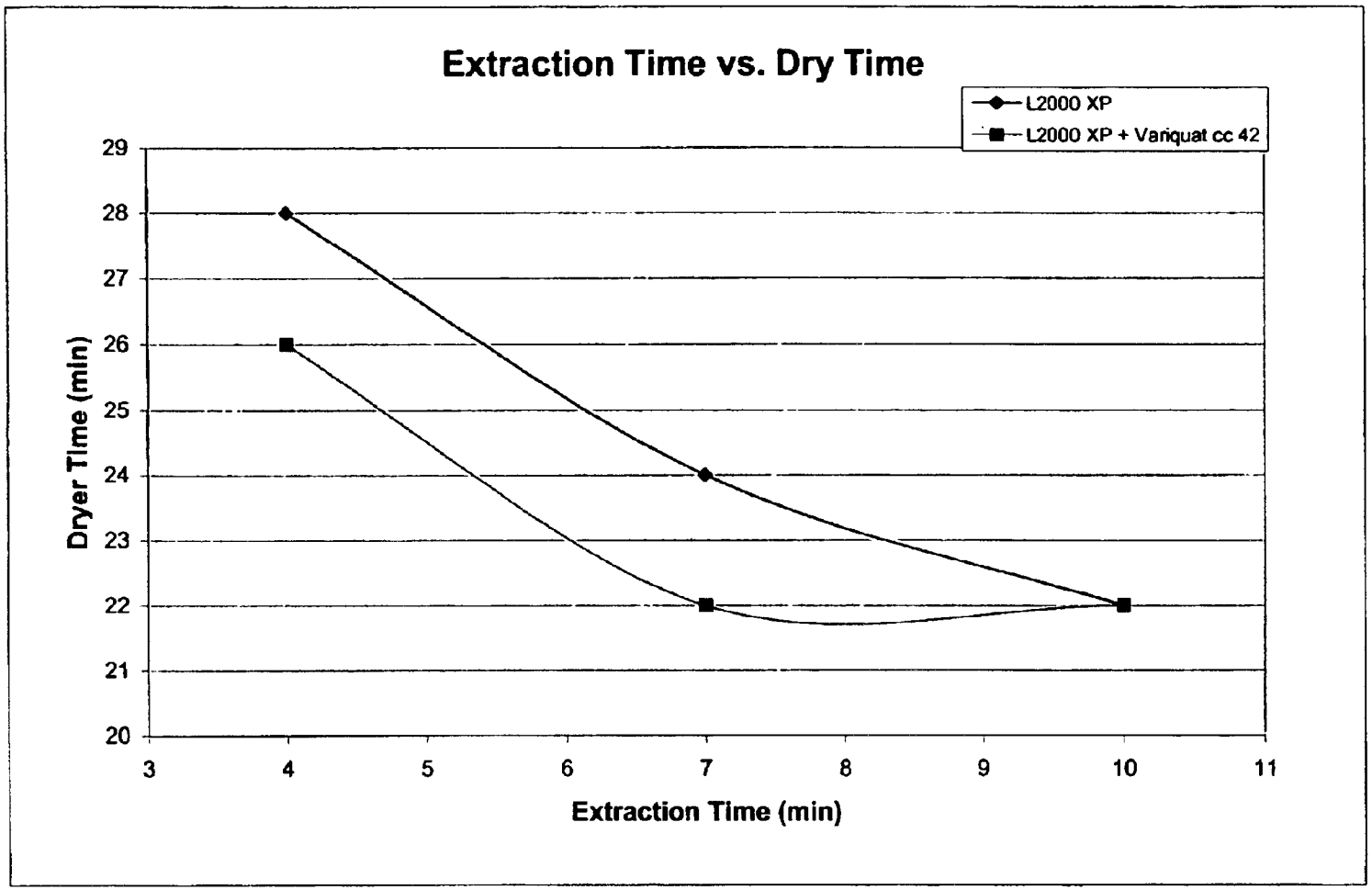
FIG. 4 is a graph of Extraction Time verses Dry Time using a rinse aid of the invention.
Figure 5:
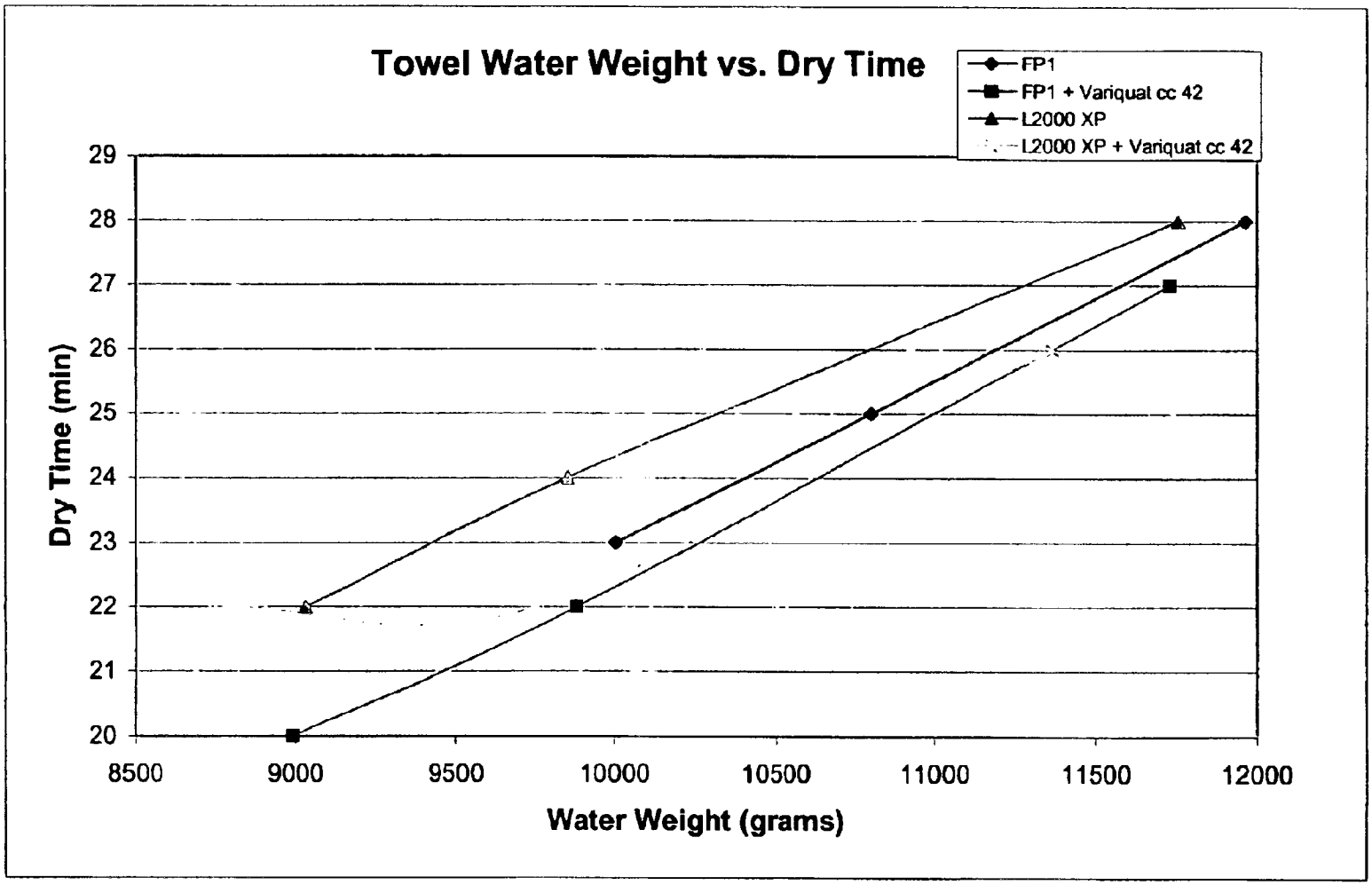
FIG. 5 is a graph of Towel Water Weight verses Dry Time using a rinse aid of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The present invention is believed to be applicable to fabrics and their associated washing process. The present invention is also directed to reducing the amount of energy to remove water from fabrics. While the present invention is not so limited, an appreciation of various aspects of the invention will be gained through a discussion of the examples provided below.

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

Weight percent, percent by weight, % by weight, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

The term "alkyl" refers to a straight or branched chain monovalent hydrocarbon radical having a specified number of carbon atoms. Alkyl groups may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halo, for example. Examples of "alkyl" include, but are not limited to, methyl, ethyl, n-propyl, isopropyl, n-butyl, s-butyl, t-butyl, n-pentyl, n-hexyl, 3-methylpentyl, and the like.

The term "alkoxy" refers to refers to a straight or branched chain monovalent hydrocarbon radical having a specified number of carbon atoms and a carbon-oxygen-carbon bond, may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halo, for example. Examples include, methoxy, ethoxy, propoxy, t-butoxy, and the like.

The term "alkenyl" or "alkenylene" refers to a straight or branched chain divalent hydrocarbon radical having a specified number of carbon atoms and one or more carbon—carbon double bonds. Alkenylene groups may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halo, for example. Examples of "alkenyl" or "alkenylene" include, but are not limited to, ethene-1,2-diyl, propene-1,3-diyl, and the like.

The terms "fabric" and "fabric article", as used herein, are intended to mean any article that is customarily cleaned in a conventional laundry process or in a dry cleaning process. As such the term encompasses articles of clothing, linen, drapery, and clothing accessories. The term also encompasses other items made in whole or in part of fabric, such as tote bags, furniture covers, tarpaulins and the like.

The methods of the invention include: (a) providing a wet fabric; (b) contacting the wet fabric with a rinse aid compound; and removing water from the wet fabric.

Contacting the wet fabric with the rinse aid compound may include contacting the wet fabric with an aqueous solution including the rinse aid compound. The rinse aid compound may be present in any amount effective to enhance water removal from fabric. The rinse aid may be present in the aqueous solution in an effective amount from at least 10 ppm or 50 to 500 ppm or 100 to 250 ppm.

Wet fabric that has not been exposed to the compositions of the invention requires a first amount of drying time to remove a first amount of water from the wet fabric. When wet fabric is contacted with an effective amount of the rinse aid compound, the amount of drying time required to remove the first amount of water from the wet fabric is reduced as compared to the first amount of drying time. The drying time reduction may be, for example, at least 5%, 10%, or 20% or from 5% to 25%, 10% to 25% or from 5% to 15%. The energy used to dry and/or remove water from the fabric may include mechanical energy or thermal energy and the like. The energy used to dry and/or remove water from the fabric is presumed to be applied to the fabric at a constant rate. Thus, by applying a constant amount of mechanical or thermal energy to the wet fabric, a reduced drying time translates to a reduced amount of energy used to remove a specified amount of water from fabric.

The wet fabric may include non-woven or woven fabric such as, for example, cotton, polyester or blends thereof. The rinse aid can be added to a washing machine at any stage of the fabric washing cycle, such as, for example, the wash stage, the rinse stage, the softener stage, or the extraction stage.

The rinse aid may be a compound of the formula (I):

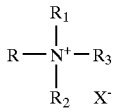

(I)

wherein; $X^-$ is an anion; R, $R_1$ and $R_2$ are independently selected from $(C_1–C_4)$alkyl; $R_3$ is a polyoxyalkylene chain of the formula:

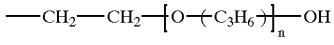

where n is 35–45. R and $R_2$ may be ethyl, $R_1$ may be methyl, n may be 40–44 and $X^-$ may chlorine.

A preferred rinse aid compound is commercially provided as GLENSURF.™ 42, provided by Glenn Corporation, this compound is also know as Variquat CC 42 NS. The CAS Number for the actual compound is 68132-96-7, its Chemical Abstract name is Poly[oxy(methy-1,2-ethanediyl)], alpha-[2-diethylmethylammonio)ethyl]-omega-hydroxy chloride, and its chemical formula is listed as $(C_3H_6O)_n$ $C_7H_{18}NO)Cl$. This compound may be generally defined according to the formula (I) above where R, $R_1$ and $R_2$ are independently lower alkyl groups ($C_1–C_4$ alkyl groups), $R_3$ may be a polyoxyalkylene chain, and X comprises an anion (any anion is useful, acid anions preferred, such as chloride, iodide, bromide, fluoride, acetate, phosphate, sulfate, etc.). A preferred type of polyoxyalkylene chain (also referred to as a poly[oxyalkylene] chain) would have the general formula:

$$—(PO)_a \text{ or } —(PO)_a\ (EO)_b, \text{ or } —(PO)_b\ (EO)_a$$

where a is an integer from 5 to 100 or 1 to 60 and b is an integer from 1 to 50 or 0 to 30 and a plus b is from 1 to 60 and a>b or a ratio of a/b be of at least 2 or 4 or 5. It is preferred that X is chloride, R is methyl, $R_1$ and $R_2$ is ethyl and $R_3$ is $—(PO)_{42}$.

A preferred compound of formula (I) is commercially available as Variquat CC-42NS from Glenn Corporation. As will be apparent to those skilled in the art, the above-listed compound of formula (I) are merely illustrative and various other compounds meeting the criteria set out above may also be used in the practice of the invention. The compound of formula (I) may be present in the fabric wash composition from 10 ppm or 50 to 1000 ppm or 50 to 500 ppm or 50 to 250 ppm or 50 to 100 ppm.

The rinse aid may be a compound of the formula (II):

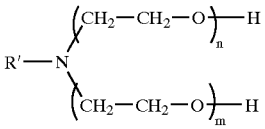

(II)

where R' may be a $(C_1–C_{25})$alkyl, $(C_1–C_{25})$alkoxy, $(C_1–C_{25})$alkenyl; n may be 1–50; m may be 1–50. R' may be $(C_{15}–C_{20})$alkyl, or $(C_3–C_{20})$alkoxy.

Preferred compounds of formula (II) are commercially available as Tomah product E-T-2 and E-19-2 from Tomah Corporation. As will be apparent to those skilled in the art, the above-listed compound of formula (I) are merely illustrative and various other compounds meeting the criteria set out above may also be used in the practice of the invention. The compound of formula (I) may be present in the fabric wash composition from 10 ppm or 50 to 1000 ppm or 50 to 500 ppm or 50 to 250 ppm or 50 to 100 ppm.

EXAMPLES

Example 1

This example examines the use of a variety of compounds for utility as a fabric rinse additives. This example processes two sets of approximately 24 lbs of cotton towels using a 35 lb Milnor washing machine and a 50 lb Hubsch dryer.

Water Baseline Data:

The average grams of water in the towels without fabric softener added was 10170 grams and the average dry time was 24.75 minutes. With fabric softener added, there was on average 10681 grams of water in the towels and it took 25 minutes to dry.

7 oz FPI vs. 7 oz L2000 XP:

A split suds and bleach cycle with 7 oz of product per 100 wt was used for both detergents (FPI is a detergent commercially available from Ecolab, St. Paul, Minn.; L2000 XP is a detergent commercially available from Ecolab, St. Paul, Minn.) with three rinses. Extraction time was 7 minutes. Towels washed with FP1 and no softener contained on average 10535 grams of water and took 23.5 minutes to dry. Towels washed L2000 XP and no softener contained on average 9183 grams of water and took 21 minutes to dry. Therefore, it took 2.5 minutes longer to dry FI towels than L2000 XP towels in the lab using both weight and relative humidity measurements to between 15 and 20% RH in the lint compartment of the dryer without softener. Towels washed with FPI and softener contained on average 11221 grams of water and took 26 minutes to dry. Towels washed with L2000 XP and softener contained on average 9233 grams of water and took 22.5 minutes to dry. Therefore, with softener it took 3.5 minutes more for FP1 towels to dry than L2000 XP towels.

10 oz FP1 vs. 9 ox L2000 XP:

A split suds and bleach cycle with 10 oz of FPI or 9 oz of L2000 XP per 100 wt was used with three rinses. A separate set of cycles with 10 oz FP1 in a suds bleach combination with two rinses was also used. Extraction time was 7 minutes. Towels washed in FP1 and softener under split suds/bleach conditions contained on average 10695 grams of water and took 25.3 minutes to dry. Towels washed in FP1 with softener under suds/bleach combination conditions contained on average 10902 grams of water and took 25.5 minutes to dry. Towels washed in L2000 XP contained 9853 grams of water on average and took 24 minutes to dry. Thus, at higher concentrations of detergent there is no difference in dry times with a shorter wash cycle with FP1 and it takes about 1–1.5 minutes longer to dry FP1 towels than L2000 XP towels. All further experiments were carried out using a suds/bleach combination for FP1 and L2000 XP will use the split wash formula. All experiments will use the higher concentrations of detergent.

(commercially available from Ecolab, St. Paul, Minn.), the softener used for these studies. Any rinse additives used for this study were added in replacement of the fabric softener in the final step before extraction. The amount added to the final step was based on the amount of quat used in So-Fresh and the activity of the sample. The 8 additives used for this study were Abil B 8852, Abil Quat 3272 and Abil B9950 (commercially available from DeGussa, Dusseldorf, DE), Variquat CC-42NS' and Variquat CC-9NS (commercially available from Goldschmidt a division of DeGussa), Mackanate DC-50 (commercially available from McIntyre Group, Ltd.), Rewoquat SQ1 (commercially available from DeGussa, Dusseldorf, DE), and DC-161. The results from this study are summarized in Tables 1 and 2 below.

TABLE 1

FP1

| Additive | Abil 9950 | Abil 8852 | Variquat cc42 NS | Variquat cc 9NS | DC-161 | Mackanate DC50 | Abil Quat 3272 | Rewoquat SQ1 |
|---|---|---|---|---|---|---|---|---|
| Wash cycle | Suds combo | Suds combo | Suds combo | Suds combo | Suds combo | Suds combo | Suds combo | Suds combo |
| Amount detergent (grams) | 10 | 10 | 10 | 10 | 10 | 10 | 10 | 10 |
| Grams water end wash cycle | 10392 | 10218 | 9882 | 10220 | 10073 | 10109 | 10389 | 10350 |
| Grams water end of dry cycle | 10 | 4 | −99 | 394 | 25 | −74 | −67 | 48 |
| Dry Time | 26 | 24 | 22 | 23 | 23 | 24 | 24 | 23 |

TABLE 2

L2000 XP

| Additive | Abil 9950 | Abil 8852 | Variquat cc42 NS | Variquat cc 9NS | DC-161 | Mackanate DC50 | Abil Quat 3272 | Rewoquat SQ1 |
|---|---|---|---|---|---|---|---|---|
| Wash cycle | Split | Split | Split | Split | Split | Split | Split | Split |
| Amount detergent (grams) | 9 | 9 | 9 | 9 | 9 | 9 | 9 | 9 |
| Grams water end wash cycle | 9734 | 9770 | 9751 | 10197 | 9672 | 9769 | 10126 | 9673 |
| Grams water end of dry cycle | 385 | −76 | −161 | −136 | −264 | 261 | 362 | −156 |
| Dry Time (min) | 25 | 25 | 22 | 23 | 24 | 22 | 23 | 23 |

Reduced Dryer Temperature Study:

For this experiment, towels were dried at a medium temperature of 190° F. rather than the cotton high temperature of 230° F. Towels washed in FP1 and softener contained on average 10712 grams of water and took 27.5 minutes to dry. Towels washed in L2000 XP and softener contained on average 9215 grams of water and took 26.5 minutes to dry. Thus, even at lower temperatures it takes about a minute longer to dry FP1 Towels than L2000 XP Towels in the lab.

Rinse Additives Study:

For this experiment, it was determined that about 1.8 grams of 100% active quat was used in So-Fresh The results indicate that Variquat CC-42NS provides unexpected utility as a rinse additive because the dryer time is significantly reduced when this compound is added to the final rinse.

Extraction Time Study:

For this test, the correlation between the extraction time in the wash wheel and the time it takes to dry the towels was examined. The study was completed with So-Fresh added to the final rinse and with Variquat CC-42NS added to the final rinse before extracting. Extraction times were examined at 4, 7 and 10 minutes for both L2000 XP and FP1. The results of the test are summarized in Tables 3 and 4 below.

TABLE 3

| | L2000 XP | | | | | |
|---|---|---|---|---|---|---|
| Additive | So-Fresh | So-Fresh | So-Fresh | Vari-quat c42 | Vari-quat cc42 | Variquat cc42 |
| Wash cycle | Split | Split | Split | Split | Split | Split |
| Amount detergent (grams) | 9 oz | 9 oz | 9 oz | 9 oz | 9 oz | 9 oz |
| Extraction time (min) | 4 | 7 | 10 | 4 | 7 | 10 |
| Grams water end wash cycle | 11756 | 9853 | 9031 | 11367 | 9751 | 8782 |
| Grams water end of dry cycle | −113 | 112 | 192 | 107 | −161 | −79 |
| Dry Time (min) | 28 min. | 25 min. | 23 min. | 27 min. | 22 min. | 20 min. |

TABLE 4

| | FP1 | | | | | |
|---|---|---|---|---|---|---|
| Additive | So-Fresh | So-Fresh | So-Fresh | Variquat c42 | Variquat cc42 | Variquat cc42 |
| Wash cycle | Suds combo | Suds combo | Suds combo | Suds combo | Suds combo | Suds combo |
| Amount detergent (grams) | 10 oz/cwt | 10 oz/cwt | 10 oz/cwt | 10 oz/cwt | 10 oz/cwt | 10 oz/cwt |
| Extraction time (min) | 4 | 7 | 10 | 4 | 7 | 10 |
| Grams water end wash cycle | 11965 | 10802 | 10004 | 11731 | 9882 | 8991 |
| Grams water end of dry cycle | −33 | 212 | −179 | 245 | −99 | 190 |
| Dry Time (min) | 28 min. | 25 min. | 23 min. | 27 min. | 22 min. | 20 min. |

The correlation between extraction time, water weight in the towels, and dryer times are summarized in FIGS. 1–5. These Figures show that an increase in extraction time decreases the dryer time, and the dryer time and amount of water extracted increases with the addition of Variquat CC-42 NS. This compound has utility as both a fabric softener and rinse aid for fabric.

Study of Variquat CC-42 NS in Suds and Softener Steps

For this study, 1.8 grams of Variquat CC-42 NS was added to either the suds step or to the softener step with So-Fresh. Towels washed in FP1 with the Variquat CC-42NS added to the suds step contained 9910 grams of water and took 23 minutes to dry. Towels washed in the L2000 XP with the Variquat CC-42 NS added to the suds step contained 10202 grams of water and took 23 minutes to dry. Towels washed in the L2000 XP with the Variquat CC-42 NS added to the softener step contained 9720 grams of water and took 22 minutes to dry. Thus, it does not matter where the Variquat is added to the wash cycle because the grams of water in the towels and the dry times are substantially the same as in the study above.

Example 2

Thirty-seven products were screened in the washwheel for their effect on drying time. Post extraction weight determinations show that addition of Tomah product E-T-2 and E-19-2 to the rinse cycle result in the least amount of water retained on the towels after extraction. A multiple wash study and soil re-deposition test was preformed using these two Tomah products, So-Fresh and an additive-free control. Post extraction weight, drying rate, absorbency and whiteness were determined for four separate loads of 16 cotton towels. FP1 detergent and XY12 bleach were added to the first step of the wash cycle, and either the Tomah products or So-Fresh softener was introduced in the rinse before extraction. The post extraction weights decreased by 9.6%, 12.8% and 11.4% when compared to an additive-free control for E-T-2, E-19-2, and So-Fresh additives respectfully. A plot of the mass of water retained on the towels per minute dry time can be represented by a second order polynomial equation. This equation indicates that the additive-free control load requires 34.8 minutes of drying time to reach dry load weight. The drying time is reduced to 33.2 minutes when E-T-2 is added to the rings, and 30.5 and 30.7 minutes for E-19-2 and so-Fresh respectively. The absorbency and the whiteness retention are comparable for the three additives before and after the soil redeposition test. It appears that after 18 washes with the product, the product is not accumulating on the towels to dramatically affect the absorbency and the whiteness of the towels is not greatly affected by either the product or the soil redeposition.

Towel Preparation

New cotton terry towels from storage were scoured according to Laundry SOP, IPDTP No. 3.

Wash Program

A five step wash program was used on the 35 lb. Milnor machine for all studies. Briefly, FP1 and bleach were added in the first step, followed by three rinses with softener or product added to the last rinse, and a 7-minute extraction time as shown in Table 5 below.

TABLE 5

| Step | Minute | Temperature | Chemical Added | Amount Per 100 lb | g. chemical for 35 lb load |
|---|---|---|---|---|---|
| 1 | 7 | 120 | FP1 | 10 oz | 135 |
| | | | XY12 | 5 oz | 61 |
| 2 | 2 | Split | | | |
| 3 | 2 | Split | | | |
| 4 | 4 | Split | So-Fresh product | 3 oz | 1.8 g active |
| 5 | 7 | n/a | | | |

Multiple Wash Study

A multiple wash study was performed to determine the accumulation effect of the product on the post extraction weight, drying rate, absorbency and whiteness of the towels. The towels were washed a total of eight times-three times according to the wash cycle outlined above using 12.8 g. active, and an additional five times using 5.4 g. active product. The re-wet test was preformed using the procedure supplied by CSMA Test Method D-13D-Modified, Book No. 10428, p. 143. The whiteness retention is calculated from Hunter Lab System data as $WI_{product}/WI_{additive\ free}\times 100$. The results are summarized in Table 6 below.

TABLE 6

| | Post extraction weight (% decrease) | Drying time (min) | Re-wet test (cm) | Whiteness retention |
|---|---|---|---|---|
| Additive-free | — | 34.8 | 7.4 | 100 |
| E-T-2 | 9.6 | 33.2 | 6.5 | 97.8 |
| E-19-2 | 12.8 | 30.5 | 6.5 | 91.5 |
| So-Fresh | 11.4 | 30.7 | 5.4 | 93.9 |

Drying Curves

Figure 6:
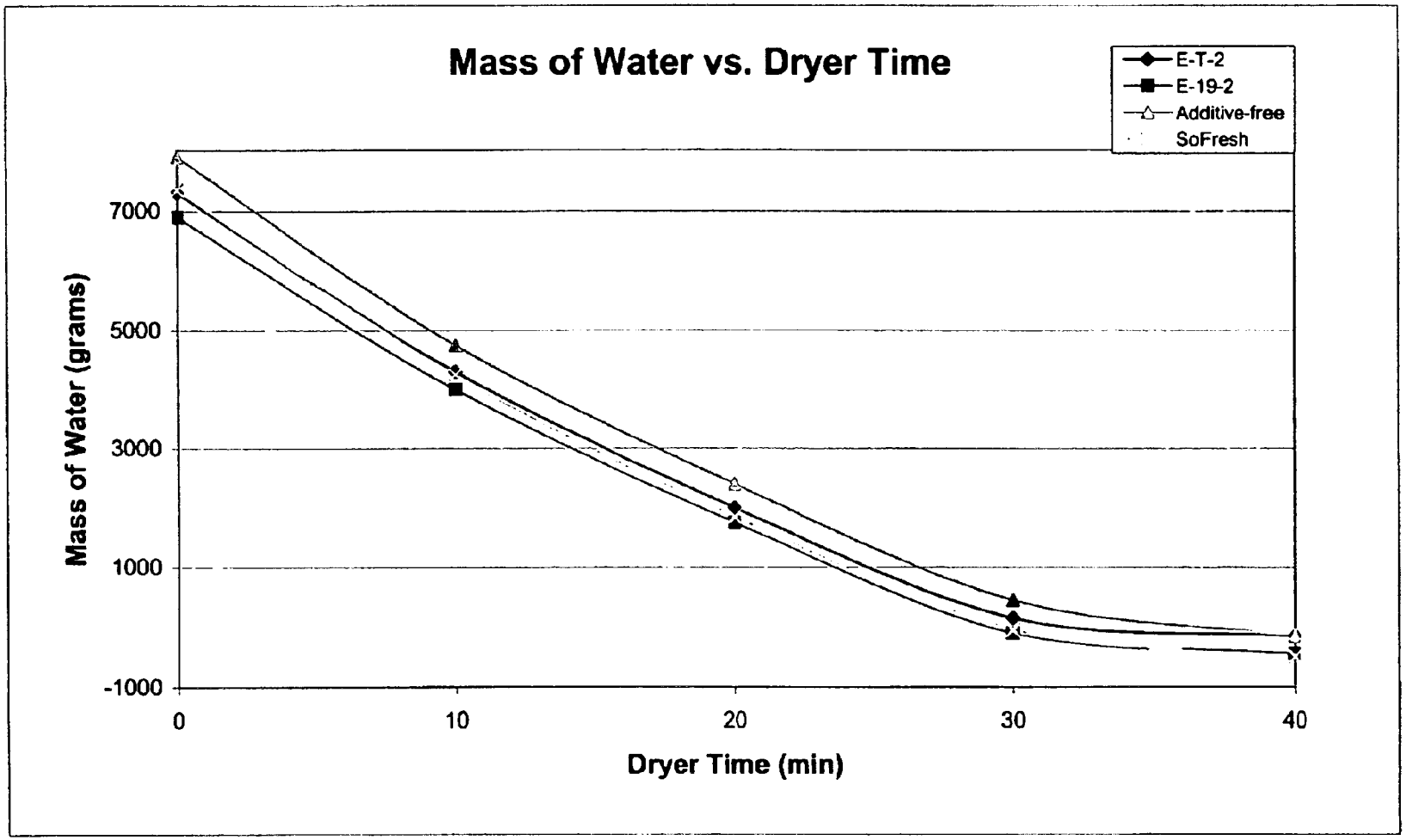
FIG. 6 is a graph of Mass of Water verses Dryer Time using a rinse aid of the invention.

The drying times were obtained by weighing the load of towels after 0, 10, 20, 30 and 40 minutes of drying time at the cotton/high heat setting. This test was preformed after the multiple wash study was complete. A plot of the mass of water retained on the towels per minute dry time can be represented by a second order polynomial equation. Using the quadratic equation to solve the polynomial for y−0 yields the values shown in FIG. 6 above.

Soil Redeposition

A soil redeposition test was preformed after the multiple wash study following the procedure as outlined in Laundry SOP, IPDTP No. 27. The wash cycle was modified to include a two-minute flush at the beginning of the cycle to allow the addition of 300 ppm each of bandy black clay and corn oil. Ten cycles were completed on the four different loads, measuring the absorbency and whiteness after five and ten cycles. The results are summarized in Table 7 below.

TABLE 7

| | Re-wet test initial* (cm) | Re-wet after 5 washes soil redep** (cm) | Rewet after 10 washes soil redep** (cm) | Whiteness retention initial* | Whiteness retention after 5 washes soil redep** | Whiteness retention after 10 washes soil redep** |
|---|---|---|---|---|---|---|
| Additive-free | 7.4 | 7.8 | 7.5 | 100 | 100 | 100 |
| E-T-2 | 6.5 | 7.2 | 6.6 | 97.8 | 92.8 | 91.4 |
| E-19-2 | 6.5 | 7. | 6.9 | 91.2 | 94.0 | 94.1 |
| So-Fresh | 5.4 | 6.5 | 6.4 | 94.5 | 95.9 | 93.5 |

*Initial readings taken after multiple wash study
**1.8 g active/wash

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

We claim:

1. A method for washing fabrics comprising contacting a fabric with a cleaning composition comprising:

a. water; and b. 50 to 500 ppm of a compound of formula (I):

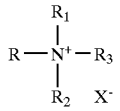

(I)

wherein;

X' is an anion;

R, $R_1$ and $R_2$ are independently selected from $(C_1-C_4)$ alkyl, or $(C_1-C_4)$alkoxy;

$R_3$ is a polyoxyalkylene chain of formula:

$$—CH_2—CH_2—[O—(CH_3H_6)]_n—OH$$

wherein, n is 35–45.

2. The composition of claim 1, wherein R and $R_2$ are ethyl, $R_1$ is methyl, n is 40–44 and $X^-$ is chlorine.

3. A method comprising:

a. providing a wet fabric;

b. contacting the wet fabric with a compound of formula (I):

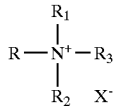

(I)

wherein;

$X^-$ is an anion;

R, $R_1$ and $R_2$ are independently selected from $(C_1-C_4)$ alkyl, or $(C_1-C_4)$alkoxy;

$R_3$ is a polyoxyalkylene chain of formula:

$$—CH_2—CH_2—[O—(C_3H_6)]_n—OH$$

wherein, n is 35–45; and c. removing water from the wet fabric.

4. The method of claim 3, wherein R and $R_2$ are ethyl, $R_1$ is methyl, n is 40–44 and $X^-$ is chlorine.

5. The method of claim 3, wherein the contacting the wet fabric with the compound of formula (I) comprises contacting the wet fabric with an aqueous solution including the compound of formula (I).

6. The method of claim 5, wherein the compound is present in the aqueous solution in an amount from 50 to 500 ppm.

7. The method of claim 3, wherein the wet fabric requires a first amount of drying time to remove a first amount of water from the wet fabric and when the wet fabric is contacted with from 50 to 500 ppm of the compound of formula (I), the first amount of drying time required to remove the first amount of water from the wet fabric is reduced by at least 5%.

8. The method of claim 7, wherein first amount of drying time required to remove the first amount of water from the wet fabric is reduced by at least 10%.

9. The method of claim 7, wherein first amount of drying time required to remove the first amount of water from the wet fabric is reduced by 10% to 25%.

10. The method of claim 7, wherein the wet fabric comprises wet cotton, polyester, or blends therof.

* * * * *